United States Patent [19]

Chern

[11] Patent Number: 4,987,803

[45] Date of Patent: Jan. 29, 1991

[54] POWER WRENCH

[76] Inventor: Shyh Y. Chern, No. 111, Lane 41, Sec. 1, Hsin Jen Rd., Ta Li Hsiang, Taichung Hsien, Taiwan

[21] Appl. No.: 507,369

[22] Filed: Apr. 9, 1990

[51] Int. Cl.[5] ..... B25B 13/46

[52] U.S. Cl. ..... 81/57.39; 81/59.1; 192/44

[58] Field of Search ..... 81/57.39, 59.1; 192/44, 192/45

[56] References Cited

U.S. PATENT DOCUMENTS 3,621,739 11/1971 Seablom ..... 81/59.1
4,051,935 10/1977 Nakayama ..... 81/59.1 X
4,603,606 8/1986 Headen ..... 81/59.1
4,722,252 2/1988 Fulcher et al. ..... 81/57.39

*Primary Examiner*—James G. Smith
*Attorney, Agent, or Firm*—Steinberg & Raskin

[57] ABSTRACT

A power wrench includes a socket which is rotatably retained in a head portion of the wrench by a retainer. A yoke is actuated to rotate reciprocally by a driving axle. A number of recesses are formed in the middle portion and the upper portion of the socket, each recess in the middle portion of the socket receives a roller, and each recess in the upper portion of the socket receives a ball. When the yoke rotates in one direction, the socket is actuated to rotate by the rollers. When the yoke rotates in a reverse direction, the balls are caused to hold the socket and prevent the socket from backlash.

2 Claims, 5 Drawing Sheets

POWER WRENCH

BACKGROUND OF THE INVENTION

The present invention relates to a wrench, and more particularly to a power wrench.

A power wrench which is driven by bearing member is disclosed in U.S. Pat. No. 4,603,606 to Headen. A yoke 72 is actuated to rotate with a reciprocating arcuate motion by a rotation of a drive shaft 86 via a pivot ball 80, as shown in FIG. 6 of this patent. The cartridge 10 is driven by the arcuate motion of the yoke 72, and the shaft 16 is driven to rotate by the roller bearing 18. The shaft 16 should be stably held in position by a retaining force in order to prevent the shaft 16 from "backlash" when the core 20 of the cartridge 10 rotates backward. The retaining force should be overcome by the power driving the drive shaft 86. The efficiency thereof is increased on the order of 30% which is unsatisfactory.

The present invention has arisen to mitigate and/or obviate the afore-described disadvantages of the conventional power wrench.

SUMMARY OF THE INVENTION

The primary objective of the present invention is to provide a power wrench which conserves energy and has an excellent efficiency.

In accordance with one aspect of the invention, there is provided a power wrench which includes a yoke rotatably supported on a socket. The socket is rotatably retained in a head portion of the wrench by a retainer. The yoke is actuated to make a reciprocating arcuate motion by a driving axle. A number of recesses are formed in the middle portion and the upper portion of the socket, each recess in the middle portion of the socket receives a roller, and each recess in the upper portion of the socket receives a ball. When the yoke rotates in one direction, the socket is actuated to rotate by the rollers. When the yoke rotates in a reverse direction, the balls are caused to hold the socket and prevent the socket from backlash.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
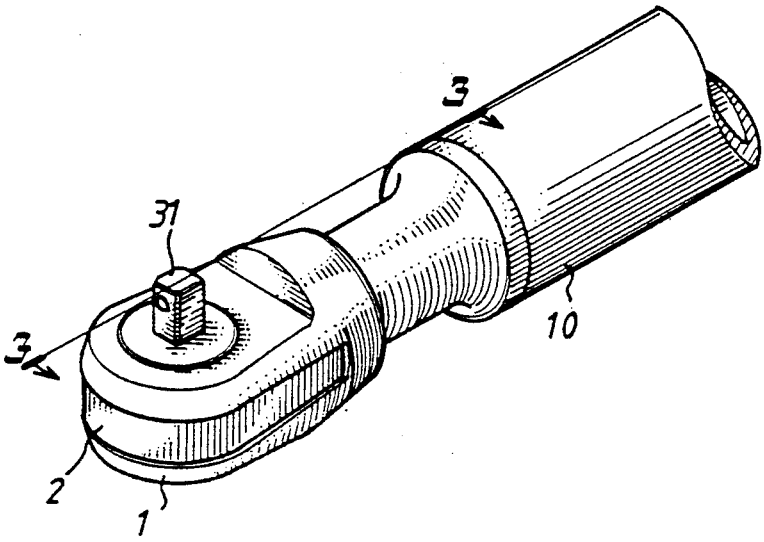
FIG. 1 is a partial perspective view of a power wrench in accordance with the present invention.
Figure 2:
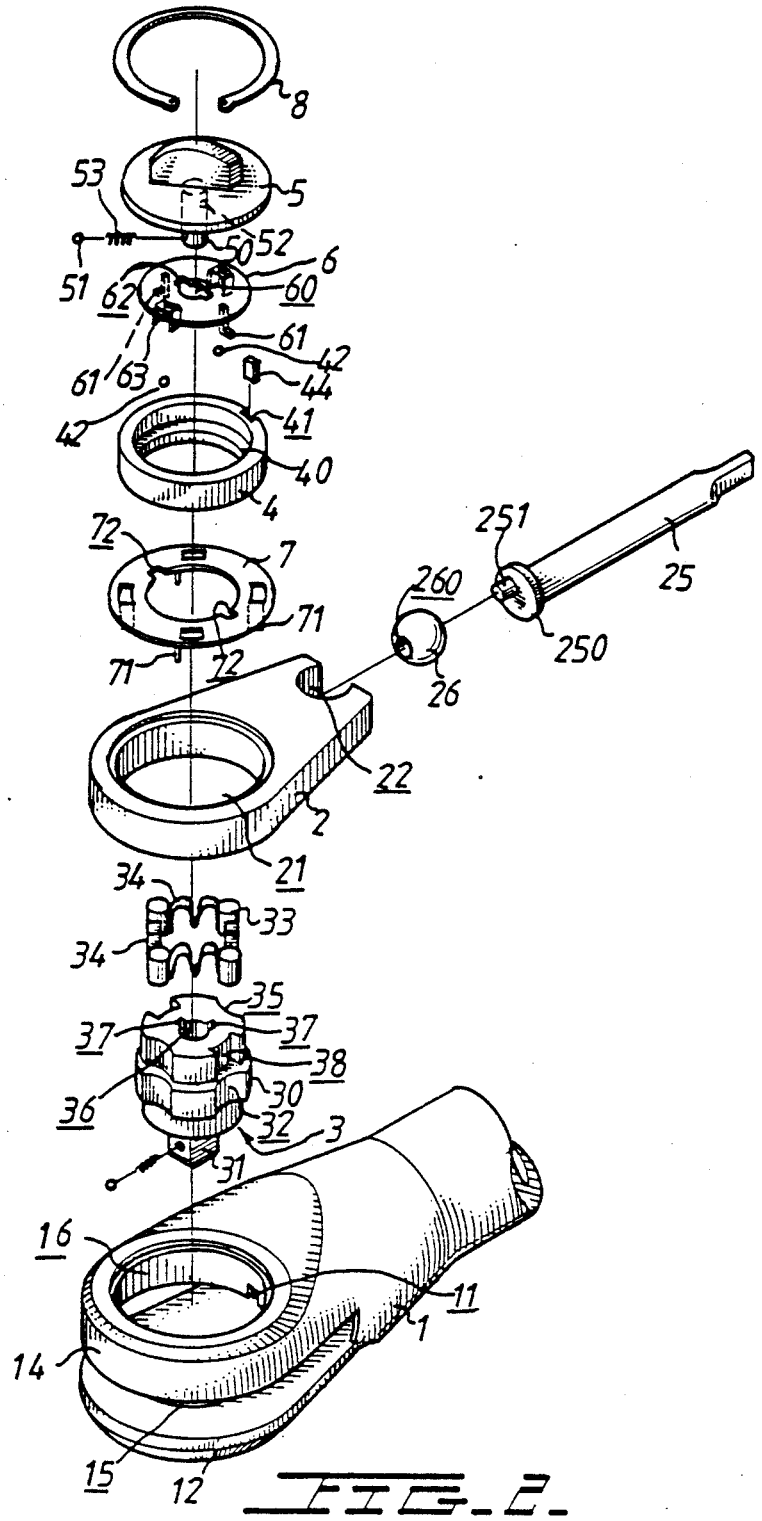
FIG. 2 is an exploded view of the power wrench.
Figure 3:
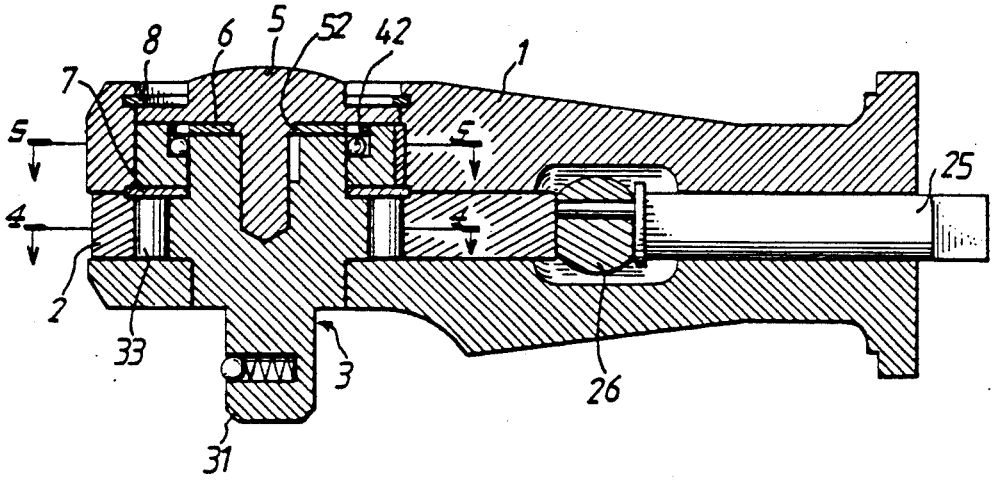
FIG. 3 is a cross sectional view taken along lines 3—3 of FIG. 1.

Referring to the drawings and initially to FIGS. 1, 2 and 3, the power wrench in accordance with the present invention comprises generally a head portion 1 and a handle portion 10 extending therefrom.

Two lugs 12, 14, each having a circular opening 15, 16, are integrally formed on a free end of the head portion 1 and face each other. The diameter of the opening 16 is larger than that of the opening 15. A notch 11 is formed in the lug 14. A yoke 2 which has an aperture 21 is received in the head portion 1 between the lugs 12, 14. A cavity 22 is formed in a neck portion of the yoke 2 for receiving a pivot ball 26. The pivot ball 26 which has a hole 260 is adapted to mount on a rotatable eccentric driving axle 25 having an enlarged collar portion 250 disposed thereupon. A pin 251 is integrally fixed on the collar portion 250 and is engaged in the hole 260 of the pivot ball 26. A rotation of the eccentric driving axle 25 produces a reciprocating arcuate motion of the yoke 2, which is well known in the art.

A socket 3 has a ring portion 30 of enlarged diameter formed in an intermediate portion thereof. A drive shaft 31 is integrally formed in a lower end of the socket 3. Four arcuate recesses 32 are formed on the outer peripheral surface of the ring portion 30 and are equally spaced. Four rollers 33 are received in the arcuate recesses 32, and four substantially M-shaped spring element 34 are provided between the rollers 33, best shown in FIG. 4. The rollers 33 and the ring portion 30 are substantially located in the aperture 21 of the yoke 2. The rollers 33 slidably contact the inner surface of the yoke 2. Two opposite arcuate recesses 35 and two opposite depressions 38 are formed on an outer peripheral surface of an upper end of the socket 3. A center hole 36 is formed in the upper end of the socket 3, and two grooves 37 which are 90 degrees apart are formed in the peripheral surface of the center hole 36. A ring element 7 has four equally spaced guide lugs 71 extending downward therefrom. The guide lugs 71 are engaged in the middle portion of the spring elements 34 so that the spring elements 34 and the ring element 7 rotate in concert. Two notches 72 are oppositely formed in the ring element 7.

A retainer 4 which is substantially ring shaped has an annular flange 40 formed in an inner and lower end thereof. The retainer 4 is substantially located within the lug 14 and surrounds the upper end of the socket 3. A notch 41 is formed in the retainer 4. A key 44 is engaged in the notch 41 and the notch 11 of the head portion 1 for limiting a rotational movement of the retainer 4. A disc 6 has a center hole 60 and two notches 62 formed in a center thereof. Two opposite legs 61 extend downward from the disc 6. The legs 61 are substantially L-shaped and are located in the depressions 38 of the socket 3. The lower ends of the legs 61 are engaged with the notches 72 of the ring element 7 so that the disc 6 and the ring element 7 rotate in concert. Two opposite pairs of stops 63 extend downward from the disc 6. The stops 63 and the legs 61 are substantially 90 degrees apart. A roller or a ball 42 is received between each pair of stops 63. The balls 42 are located in the recesses 35 of the upper end of the socket 3 and slide along the upper surface of the annular flange 40 of the retainer 4.

A knob 5 has a rod 50 extending downward and received in the center hole 36 of the socket 3. A ball 51 and a spring 53 are received in a lower end of the rod 50. The spring 53 biases the ball 51 to engage with either notch 37. Two opposite protrusions 52 are formed on an upper end of the rod 50 and are engaged with the notches 62 of the disc 6 so that the knob 5 and the disc 6 rotate in concert. A retaining ring 8 is engaged within the upper end of the lug 14 for retaining the knob 5 in place. A rotation of the knob 5 causes the disc 6, the ring element 7 and the spring elements 34 to rotate so that the rollers 33 are caused to move toward either end of the recesses 32 (FIGS. 4, 6) and the balls 42 are caused to move toward either end of the recesses 35 (FIGS. 5, 7).

Figure 4:
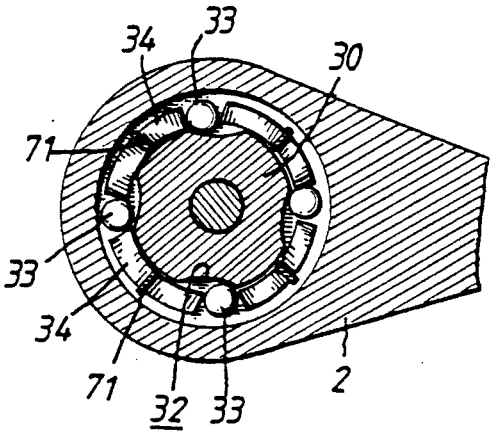
FIG. 4 is a cross sectional view taken along lines 4—4 of FIG. 3.
Figure 5:
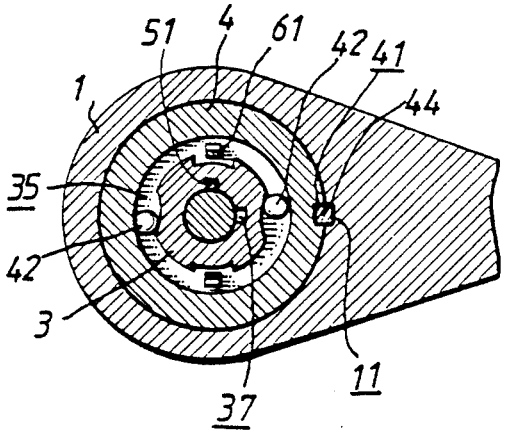
FIG. 5 is a cross sectional view taken along lines 5—5 of FIG. 3.

Referring next to FIGS. 4 and 5, the knob 5 is rotated counterclockwise so that the rollers 33 and the balls 42 are caused to move toward one end of the respective recesses 32, 35. When the yoke 2 is actuated by the driving axle 25 to rotate counterclockwise, the rollers 33 are caused to slide further toward the ends of the recesses 32 so that the ring portion 30 of the socket 3 is clamped by the rollers 33 and so that the socket 3 is caused to rotate counterclockwise. When the socket 3 is driven to rotate counterclockwise, as shown in FIG. 5, the balls 42 within the recesses 35 are caused to rotate relatively toward the center, which is wider, of the recesses 35 so that the socket 3 will not be clamped by the balls 42 and can freely rotate counterclockwise.

When the yoke 2 is actuated to rotate clockwise, the rollers 33 are caused to rotate toward the center, which is wider, of the recesses 32 so that the yoke 2 can not drive the socket 3 to rotate (FIG. 4). At this moment, the socket 3 has a tendency to rotate clockwise so that the balls 42 are caused to move relatively toward the ends of the recesses 35, which prevents the socket 3 from rotating clockwise (backlash) (FIG. 5). The socket 3 and the drive shaft 31 are active counterclockwise.

Figure 6:
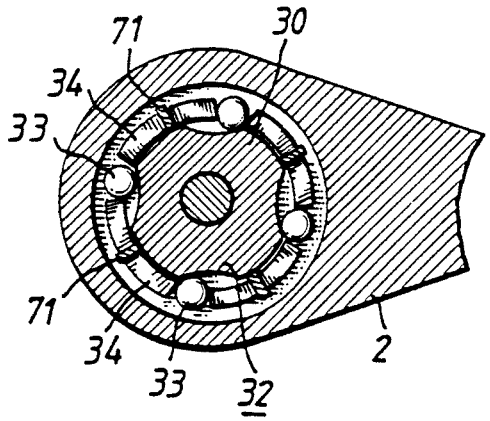
FIG. 6 is a cross sectional view similar to FIG. 4, illustrating a working position of the wrench.
Figure 7:
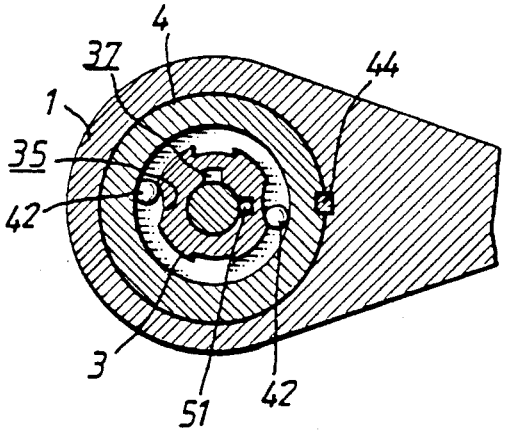
FIG. 7 is a cross sectional view similar to FIG. 5, illustrating a working position of the wrench.

Referring next to FIGS. 6 and 7, the knob 5 is rotated clockwise so that the rollers 33 and the balls 42 are caused to move toward the other end of the respective recesses 32, 35. When the yoke 2 is actuated by the driving axle 25 to rotated clockwise, the rollers 33 are caused to slide further toward the ends of the recesses 32 so that the ring portion 30 of the socket 3 is clamped by the rollers 33 and so that the socket 3 is caused to rotate clockwise. When the socket 3 is driven to rotate clockwise, as shown in FIG. 7, the balls 42 within the recesses 35 are caused to rotate relatively toward the center, which is wider, of the recesses 35 so that the socket 3 will not be clamped by the balls 42 and can freely rotate clockwise.

When the yoke 2 is actuated to rotate counterclockwise, the rollers 33 are caused to rotate toward the center, which is wider, of the recesses 32 so that the yoke 2 can not drive the socket 3 to rotate (FIG. 6). At this moment, the socket 3 has a tendency to rotate counterclockwise so that the balls 42 are caused to move relatively toward the ends of the recesses 35, which prevents the socket 3 from rotating clockwise (backlash) (FIG. 7). The socket 3 and the drive shaft 31 are active clockwise.

It is to be noted that the force required to prevent the socket 3 from backlash is small, only one ball 42 is enough to prevent the socket 3 from rotating backwards. It is also to be noted that there is no force applied to the yoke 2 when the yoke 2 is rotated in a direction opposite to an active direction of the socket 3 so that the yoke 2 may freely rotate backwards. Accordingly, the driving axle 25 does not need to overcome additional forces applied to the yoke 2 so that energy is conserved.

Since there is no additional force applied to the yoke 2 when the yoke 2 is rotated in a direction opposite to an active direction of the socket 3, there is no need for the driving axle 25 to spend additional energy to overcome additional forces. Accordingly, the power wrench in accordance with the present invention conserves energy. The efficiency thereof is greatly increased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A power wrench comprising generally a head portion and a handle portion extending therefrom, two lugs, each having an opening, being integrally formed on one end of said head portion, a socket being rotatably supported between said lugs by one of said lugs and a retainer which is disposed in said opening of an other lug, said retainer which has a center hole substantially embracing an upper end of said socket, a drive shaft being integrally formed on a lower end of said socket; a yoke which has an aperture being rotatably supported on a substantially intermediate portion of said socket, a cavity being formed in a neck portion of said yoke, a pivot ball being disposed eccentrically on an upper end of a driving axle and being slidably received within said cavity of said yoke, said neck portion of said yoke being actuated to make a reciprocating arcuate motion by said driving axle, characterized in that a plurality of first recesses are formed on an outer peripheral surface of said intermediate portion of said socket, said first recesses are substantially arcuate; a roller is received in each said first recess; a spring element is biased between every two adjacent rollers; two second recesses are formed on an outer peripheral surface of said upper end of said socket; a ball is received in each said second recess; said rollers and said balls are disposed in one end of said recesses; when said yoke is actuated to rotate in one direction, said rollers are caused to clamp and drive said socket to rotate in said one direction; and when said yoke is actuated to rotate in a reverse direction, said rollers can not clamp said socket, and said balls clamp said socket in order to prevent said socket from rotating in said reverse direction.

2. A power wrench according to claim 1, wherein said spring elements are substantially M-shaped; a ring element has a plurality of guide lugs extending downward therefrom, each said guide lug is received in a middle portion of a respective spring element; said retainer is substantially ring shaped; a disc is received in a center portion of said retainer and engaged with said ring element, two opposite pairs of stops extend downward from said disc, each said ball is received in a respective pair of stops; a knob is provided above said disc and is engaged with said disc; said spring elements, said ring element, said disc and said knob rotate in concert; and a rotation of said knob causes said rollers and said balls to rotate to either end of said recesses so that an active direction of said socket is reversible.

* * * * *